US005412935A

United States Patent [19]

Rozenwasser

[11] Patent Number: 5,412,935

[45] Date of Patent: May 9, 1995

[54] FINE JEWELRY CHAIN, LINK THEREFOR, AND METHOD OF MANUFACTURE THEREOF

[75] Inventor: David Rozenwasser, Savion, Israel

[73] Assignee: Avraham Moshe Rozenwasser, Savion, Israel

[21] Appl. No.: 89,266

[22] Filed: Jul. 9, 1993

[30] Foreign Application Priority Data

May 31, 1993 [IL] Israel ..... 105850

[51] Int. Cl.[6] ..... B21L 5/02

[52] U.S. Cl. ..... 59/80; 59/3; 59/35.1; 59/82

[58] Field of Search ..... 72/3, 35.1, 80, 82

[56] References Cited

U.S. PATENT DOCUMENTS

| | | | |
|---|---|---|---|
| 4,996,835 | 3/1991 | Rozenwasser | 59/80 |
| 5,185,995 | 2/1993 | Dal Monte | 59/80 |
| 5,285,625 | 2/1994 | Ofrat et al. | 59/80 |
| 5,303,540 | 4/1994 | Rozenwasser | 59/80 |

*Primary Examiner*—David Jones
*Attorney, Agent, or Firm*—Helfgott & Karas

[57] ABSTRACT

A link for a fine jewelry chain which includes a base defining an outward-facing surface, and a raised portion formed integrally with and extending longitudinally along the outward-facing surface of the base, wherein the raised portion has at least one diamond-cut high luster surface formed thereon.

26 Claims, 6 Drawing Sheets

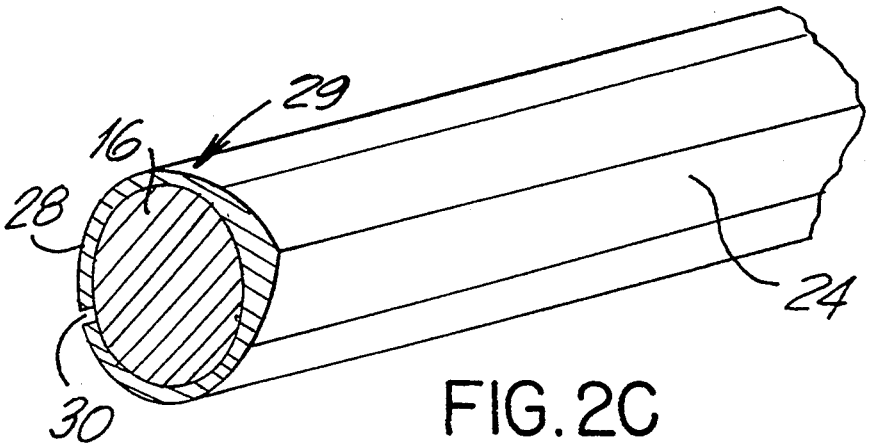
FIG. 2C
FIG. 2E 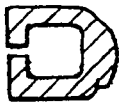
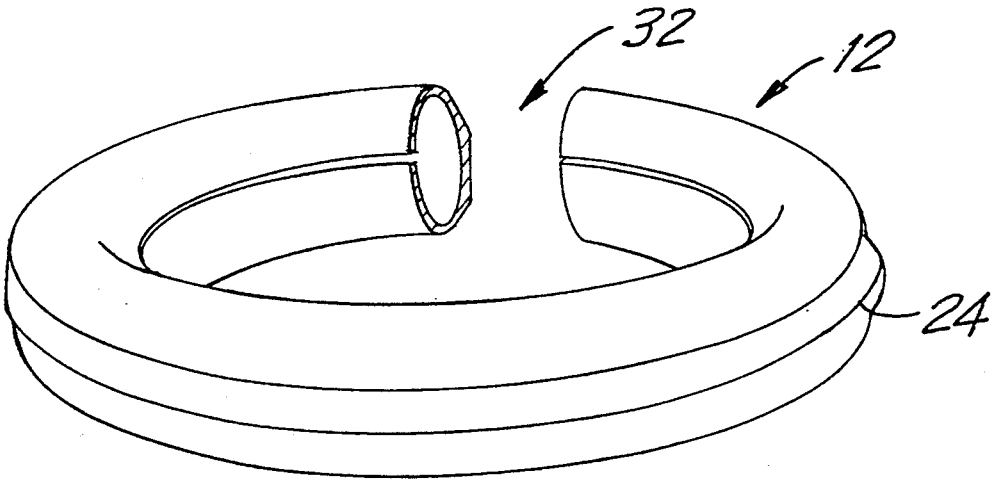
FIG. 2D

FINE JEWELRY CHAIN, LINK THEREFOR, AND METHOD OF MANUFACTURE THEREOF

FIELD OF THE INVENTION

The present invention relates to fine jewelry diamond cut chains and to methods of manufacture thereof.

BACKGROUND OF THE INVENTION

Fine jewelry chains, in general, and fine jewelry rope chains, in particular, are well known. In U.S. Pat. Nos. 4,934,135 and 4,996,835, there are disclosed rope chains and methods for preparing such rope chains having reduced weight and labor costs compared with conventional rope chains of the same chain diameter.

In the field of rope chains there are known both solid rope chains and hollow rope chains. A solid rope chain is a rope chain whose links are made from solid portions of metal, while a hollow rope chain is a rope chain whose links are hollow. While the general appearance of a rope chain is not affected by the links thereof being either solid or hollow, the amount of precious metal used in a solid rope chain of a given size is significantly greater than the amount of precious metal used in a hollow rope chain of the same size. Accordingly, a hollow rope chain of a given size is significantly cheaper than a solid rope chain of the same size.

A particularly popular type of rope chain is a diamond cut rope chain. Such a chain comprises flat cuts or facets on the outer perimeter of at least some of the chain links to provide a high luster finish so as to make the chain sparkle. Diamond cut facets are known to be formed on solid rope chains by cutting or shaving a facet from a curved section of the links.

Solid diamond cut rope chains have facets generally cut about one third or more into the thickness of the chain link in order to obtain a reasonable size-shiny surface. In this case, the amount of precious metal sheared away can be as much as 10% of the weight of the chain and although the metal shearings are collected and recycled, a significant amount of precious metal is nevertheless lost in the process.

Although it is known to form diamond cut facets on hollow rope chains, this presents certain problems due to the relative thinness of the outer wall of the hollow links used. In some cases the outer wall may be as thin as 0.05 mm. Accordingly, the forming of a facet in the way in which facets are formed on a solid rope chain would at least cause severe weakening of the outer wall of the link and would probably make a hole therein.

In U.S. Pat. No. 5,125,225 to Strobel, there is described the making of hollow rope chains. The method involves wrapping a hollow rope chain about a lathe drum, freezing the drum, applying water to the chain to freeze it in place thereby immobilizing it, and applying, by means of a burnishing tool, a plurality of incremental deformative thrusts of blunt force against some of the curved outer wall portions of the hollow links until this outer wall is deformed and pushed back towards the inner wall of the links, thus flattening portions of the curved outer wall.

The flattened portions of the outer walls are then diamond cut to remove or shave off a very thin layer of metal (about 0.001 to 0.002 mm) to provide smooth and shiny facets without making a hole in the link. The cross-section of the faceted area is deformed with respect to the cross-section of the rest of the chain link.

A disadvantage of the above-described method to Strobel is that as only a very thin layer of metal is shaved from the flattened portions, any substantial dents introduced into the surface by the thrusts of the burnishing tool will remain even after diamond cutting of the facets. Accordingly, great control is required in the flattening of the portions whereat facets are to be formed.

SUMMARY OF THE INVENTION

The present invention seeks to provide diamond cut links, which may be either solid or hollow, for a fine jewelry diamond cut chain, and a chain formed of such links, wherein the links have a generally rounded cross-section and further have a radially outward extending raised portion on which are formed diamond cut facets.

The present invention further seeks to provide a method of manufacturing a fine jewelry chain of which the links, which may be either solid or hollow, have high luster diamond cut surfaces formed thereon without deforming or significantly weakening the link wire.

There is thus provided, in accordance with a preferred embodiment of the invention, a link for a fine jewelry chain which includes a base defining an outward-facing surface, and a raised portion formed integrally with and extending longitudinally along the outward-facing surface of the base, wherein the raised portion has at least one diamond-cut high luster surface formed thereon.

Additionally in accordance with an embodiment of the present invention, the outward-facing surface is curved and the at least one diamond-cut high luster surface is parallel to a tangent or is tangential to the outward-facing surface.

Further in accordance with an embodiment of the invention, the link is a hollow link.

Additionally in accordance with an embodiment of the present invention, the base is hollow and has a predetermined wall thickness, the raised portion has a predetermined thickness, and the thickness of the link varies between:

a. a thickness that does not differ substantially from the thickness of the hollow base wall at a central portion of the high-luster surface, and b. a thickness equal to the hollow base wall thickness and the thickness of the raised portion at a location whereat the high luster surface is not provided.

Further in accordance with an embodiment of the present invention, the link is a rope chain link.

In accordance with a further preferred embodiment of the invention, there is provided a fine jewelry chain having an assembly of links as described above.

In accordance with yet a further embodiment of the invention, there is provided a method of manufacturing a diamond cut high luster fine jewelry chain including the steps of:

milling an elongate portion of a precious metal so as to provide a plurality of portions of metal link wire each having an elongate base and longitudinally oriented raised portion formed therealong; and forming each portion of link wire into the shape of a link; and diamond cutting the raised portions so as to form at least one high luster surface thereon without substantially cutting into the elongate base.

Additionally in accordance with the method of the invention, the step of forming includes the step of passing the link wire through a die so as to impart to the base and to an outward-facing surface thereof a generally curved cross-section, and the step of diamond cutting includes the step of cutting at least one high luster surface in a direction tangential to the outward-facing surface.

Further in accordance with the method of the invention, the step of forming includes the step of passing the link wire through a die so as to impart to the base and to an outward-facing surface thereof a generally curved cross-section, and the step of diamond cutting includes the step of cutting at least one high luster surface in a direction parallel to a tangent to the outward-facing surface.

Additionally in accordance with the method of the invention, the method also includes the step of assembling the plurality of chain links into a chain prior to the step of diamond cutting.

Further in accordance with the method of the invention, the step of diamond cutting includes the step of forming plural high luster surfaces about the periphery of the assembled chain simultaneously.

Additionally in accordance with the method of the invention, the step of forming comprises the step of forming each portion of link wire into a hollow link.

Further in accordance with the method of the invention, the method is a method of manufacturing a rope chain.

BRIEF DESCRIPTION OF THE DRAWINGS

The present invention will be more fully understood and appreciated from the following detailed description, taken in conjunction with the drawings, in which:

FIG. 2C is a schematic illustration of the cylindrical link member formed by folding the metal plate of FIG. 2B about its longitudinal axis;

FIG. 2D is a schematic illustration of an uncut link formed from the cylindrical link member of FIG. 2C;

FIG. 2E is a square cross-sectional representation of a chain link in accordance with the present invention.

DETAILED DESCRIPTION OF THE INVENTION

Figure 1:
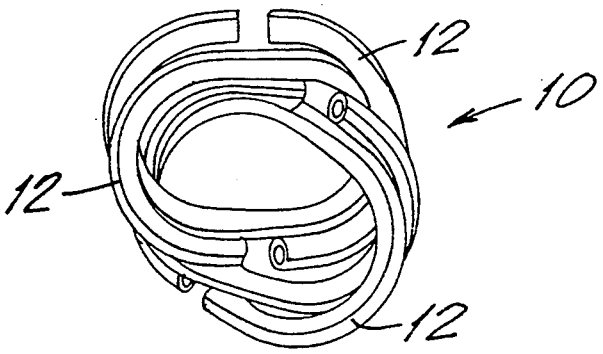
FIG. 1 is a magnified pictorial illustration of a portion of a rope chain manufactured in accordance with a preferred embodiment of the present invention.

Reference is made to FIG. 1, in which is illustrated a portion, referenced generally 10, of a fine jewelry chain. While the chain is preferably a rope chain, it may alternatively be any other type of fine jewelry chain. The chain is made up of a repeating pattern of links 12 made of a precious metal, such as gold. Preferably, the chain links 12 are assembled in interlinking fashion so as to form a continuous chain of links in the style known as a 'rope' chain. Accordingly, an entire chain is represented by the plurality of links illustrated in FIG. 1. Each link has formed thereon one or more diamond cut high luster surfaces 14, formed in accordance with the present invention.

Referring now to FIGS. 2A–4, there are illustrated various stages in the manufacture of links 12 from a strip of precious metal, formed typically of an alloy of gold or silver, for example.

Figure 2A:
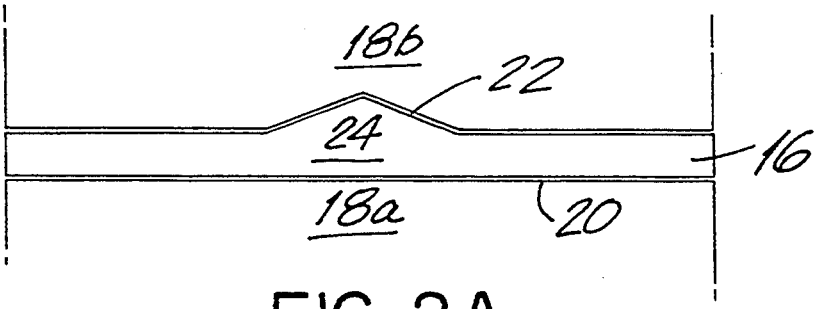
FIG. 2A is a schematic illustration of forming a metal plate for use as a link in the chain of FIG. 1.
Figure 2B:
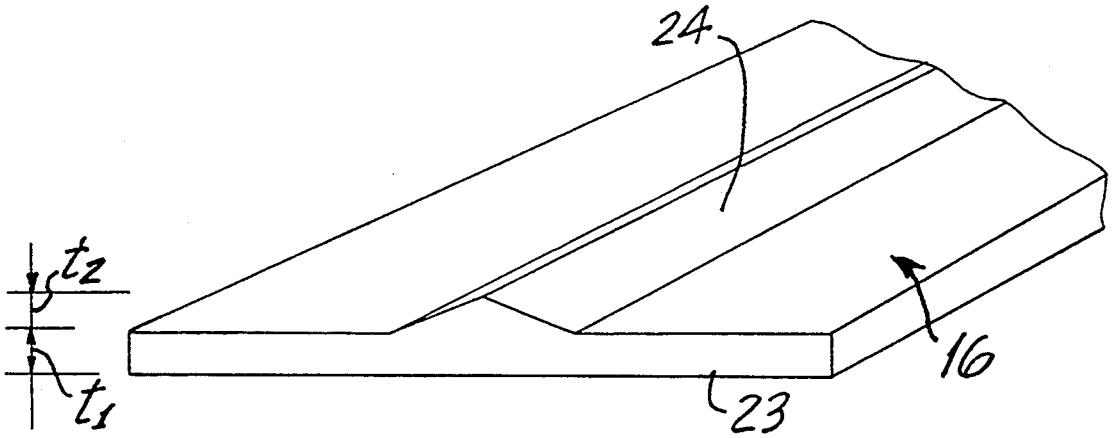
FIG. 2B is a schematic illustration of a portion of the metal plate prior to folding thereof about its longitudinal axis into a cylindrical shape.

As seen in FIG. 2A, a strip of precious metal, referenced 16, is fed through a rolling mill comprising first and second mill members referenced **18*a* and 18*b*, respectively. In the present example, mill member 18*a* has a planar milling surface 20, while the other mill member 18*b* has a groove formed therein. The groove, denoted by reference numeral 22, is provided so as to impart a raised portion 24 to the strip 16 of precious metal as it emerges from the rolling mill. Accordingly, the resulting milled strip 16 has a generally rectangular 'base' portion 23 of uniform cross-sectional thickness t1, and raised portion 24 which has an additional thickness t2**.

The groove 22 and, similarly, raised portion 24 may have any preferred configuration, so long as the thickness t2 of the raised portion 24 is sufficient so as to permit formation therein of a high luster surface of a preselected size and configuration, and which does not substantially weaken a link 12 made from the strip 16.

Referring now also to FIG. 2C, after a strip 16 has been milled as described, it is then drawn through a die (not shown) together with a soft metal wire core 26, to produce a precious metal plated wire 28 with an outward-facing surface 29 and an elongate raised portion 24. Typically, the die is round, such that the link wire produced has a similarly round cross-sectional configuration.

Alternatively, however, the link wire may have any geometric cross-section, depending on the shape of the orifice in the die through which it is drawn. Such shapes may be round, oval, elongated, triangular, hexagonal, rhombic, octagonal or irregular. For example, a square cross-sectional configuration is illustrated in FIG. 2E.

The width of the strip 16 is generally 15–20% smaller than the circumference of the soft metal core 26, thereby producing a gap 30 in the precious metal envelope covering the core 26 along the entire length of the wire 28. The purpose of this gap 30 is to provide a large surface area for acid to come in contact with the soft metal core 26 and dissolve it, leaving a hollow precious metal wire.

Chain links 12, as shown in FIG. 2D, are prepared from wire 28 in a conventional manner by winding the wire 28 into a coil and cutting the wire before each complete turn, thereby forming a helical link with a gap 32. The link is then slightly flattened so as to become unskewed, as shown in FIG. 2D, ready for use in assembling a rope chain. This gap 32 is slightly larger than the outer diameter of the hollow wire forming link 12, so that one link can be fitted into another via the gap 32. The links are then immersed in a suitable acid so as to dissolve the soft metal core 18 leaving the hollow chain link 12 as shown in FIG. 2D.

Figure 3:
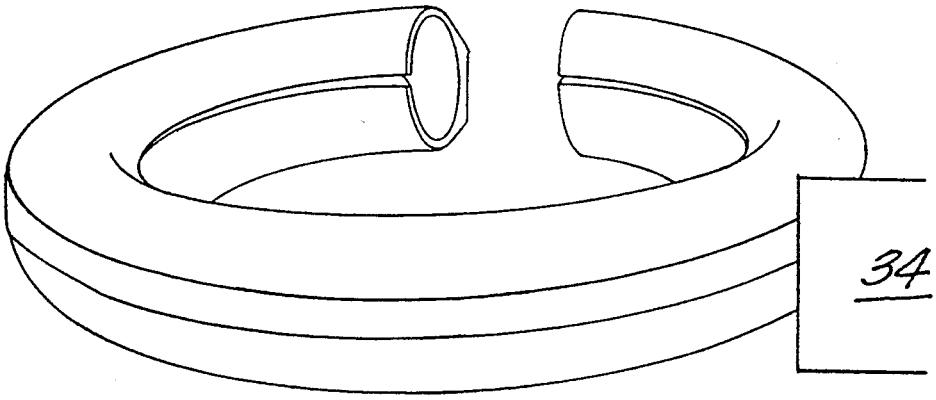
FIG. 3 is a schematic illustration of diamond cutting of a high luster surface on the uncut link of FIG. 2D.
Figure 4:
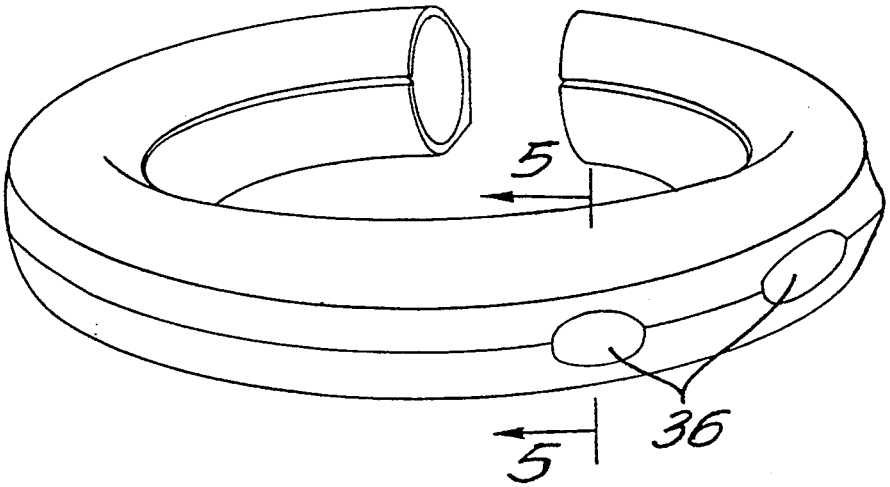
FIG. 4 is a schematic illustration of a chain link having two diamond cut high luster surfaces formed thereon by the method of FIG. 3.

Referring now to FIG. 3, a diamond cutting tool, shown schematically at 34, is used to cut one or more high luster surfaces 36 on the link 12. This is seen in FIG. 4.

Figure 5:
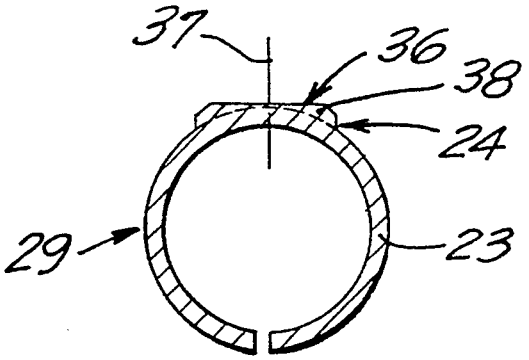
FIG. 5 is a cross-sectional representation of the chain link of FIG. 4 taken along line 5—5 thereon.

Referring now also to FIG. 5, it is seen that the high luster surface 36 is formed by cutting almost exclusively into the elongate raised portion 24 only, and that the base portion 23 of the link remains virtually intact. This is demonstrated by the broken line 38 which indicates a circular continuation of the outward-facing surface 29 of the base portion 23. In accordance with one embodiment of the invention, therefore, surface 36 is a planar surface formed tangentially with respect to the base portion 23.

According to an alternative embodiment, minimal cutting into base portion 23 may occur in a plane parallel to the tangent to the outward-facing surface of base portion 23, but to a depth so as not to significantly weaken the link.

It will thus be apparent that the wall thickness of the hollow link 12 varies between a. a thickness that does not differ substantially from the thickness of the base portion 23 at a central portion of a high-luster surface 36, taken along a center line 37 (FIG. 5) thereof, and b. a thickness equal to the sum of the thickness of base portion 23 and the maximum thickness of the raised portion 24, i.e. at a location where the raised portion is uncut.

Figure 6:
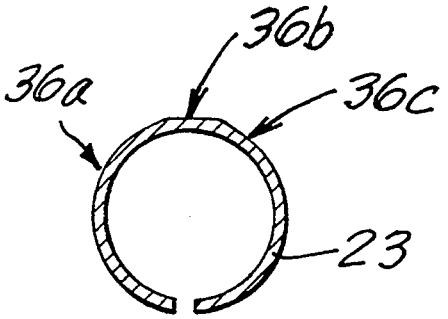
FIG. 6 is a cross-sectional representation of a chain link formed in accordance with an alternative embodiment of the invention.

Referring now also briefly to FIG. 6, it is seen that, in accordance with a further embodiment of the invention, a plurality of high luster surfaces, referenced 36*a*, 36*b* and 36*c* may be provided on raised portion 24 of link 12. Each of surfaces 36*a*–36*c* is tangential to or parallel to a tangent of the outward-facing surface 29 of the base portion 23, and the overall effect of the provision of the plurality of surfaces is to provide a larger high luster surface area than that produced by provision of merely a single high luster surface.

It will be appreciated by persons skilled in the art that a major advantage of the present invention is that, as opposed to the prior art, the formation of high luster surfaces 36 on only the raised portion 24 of a hollow link does not weaken the link and does not require precautions to be taken so as to prevent such weakening from occurring during diamond cutting of the high luster surfaces.

Accordingly, a major benefit from the formation of diamond cut high luster surfaces on a raised portion of a link is realized when the link is hollow, and that as formation of a high luster surface does not necessarily require removal of link wire metal from the base of the link, the thickness of the base can be minimal.

According to a further embodiment of the invention, however, link 12 may be solid.

The method of manufacture of a fine jewelry chain described hereinabove in conjunction with FIGS. 3A–4 involves diamond forming high luster surfaces 36 (FIGS. 3 and 4) on individual links 12, prior to assembly thereof into a chain 10.

In accordance with an alternative preferred embodiment of the invention, a plurality of links of the invention is assembled into a chain prior to the diamond forming of high luster surfaces thereon.

Figure 7:
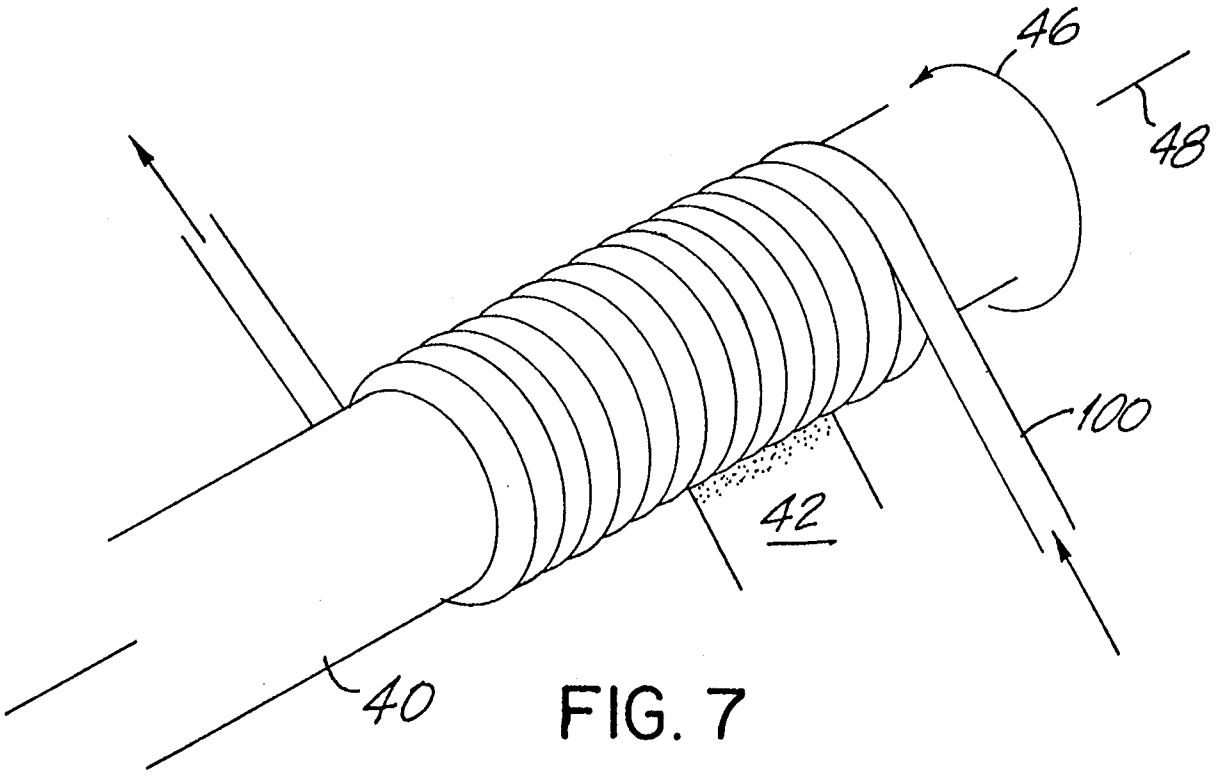
FIG. 7 is a schematic illustration of diamond cutting of an assembled chain in accordance with an alternative embodiment of the present invention.

Referring now to FIG. 7, there is shown an assembled uncut chain 100 (shown schematically) which is wound around a support 40. A diamond cutting tool is shown schematically at 42. As indicated by arrow 46, support 40 is rotated about an axis 48, thereby to cause a corresponding feeding of chain 100 thereabout, in engagement with tool 42. As chain 100 is fed past tool 42, a predetermined portion of an outward-facing surface of the chain is brought into diamond cutting engagement with the tool 42, such that raised portions 24 (FIGS. 2D–5) have high luster surfaces formed thereon, substantially as shown at 36 in FIGS. 4, 5 and 6.

Figure 8A:
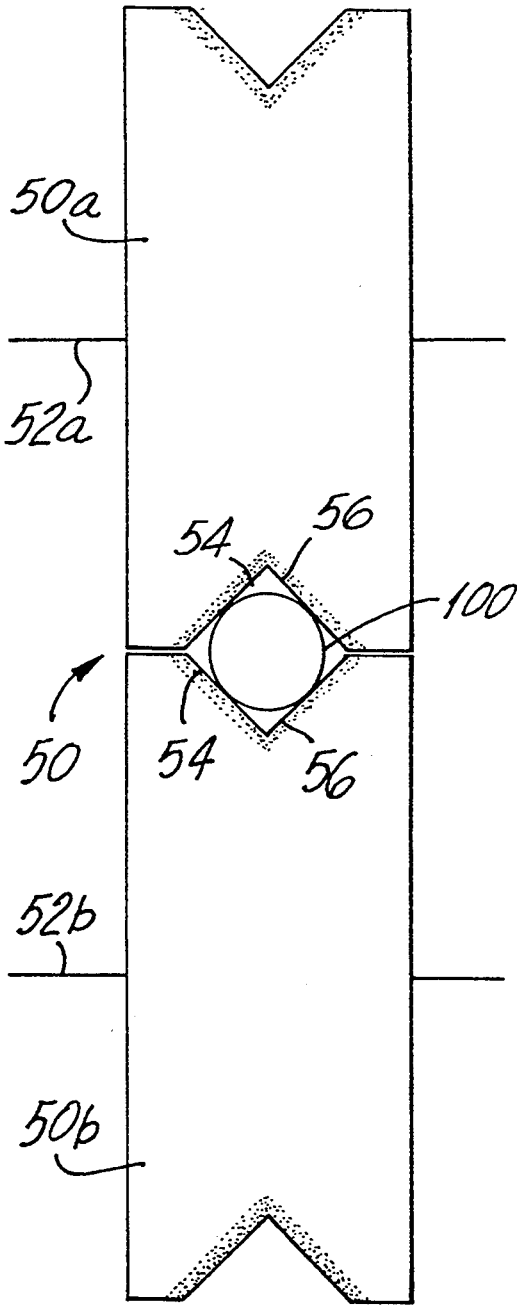
FIGS. 8A and 8B are schematic illustrations of diamond cutting of an assembled jewelry chain in accordance with further embodiments of the present invention.
Figure 8B:
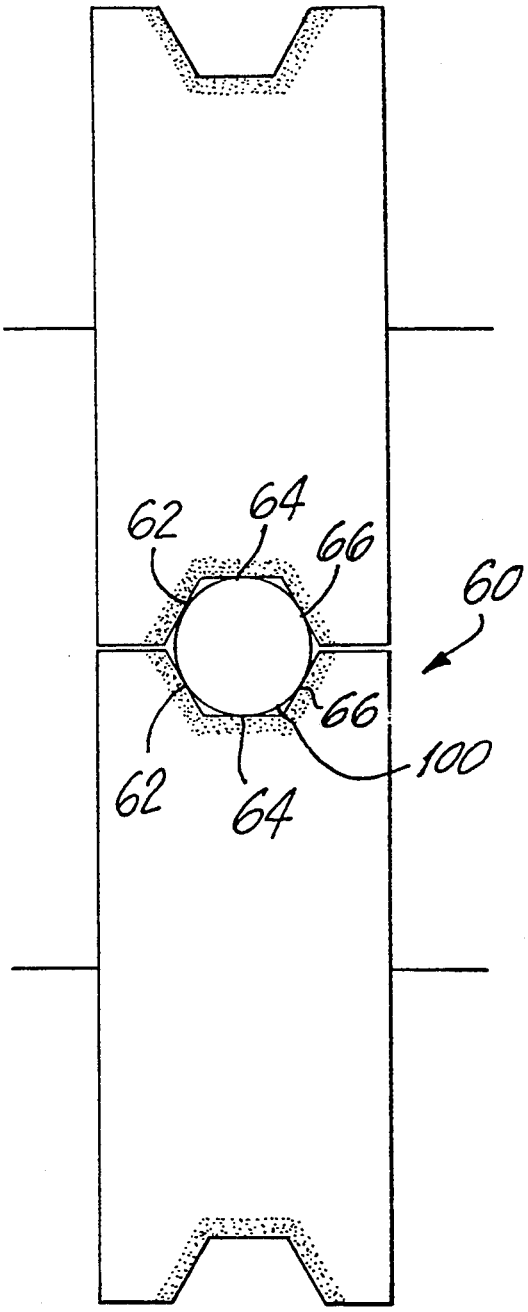

Reference is now made to FIGS. 8A and 8B, in which are shown diamond grinding wheels, respectively referenced 50 and 60, operative to provide high luster surfaces 36 (FIGS. 4, 5 and 6) to chain 100, in accordance with yet further embodiments of the invention.

Figure 9A:
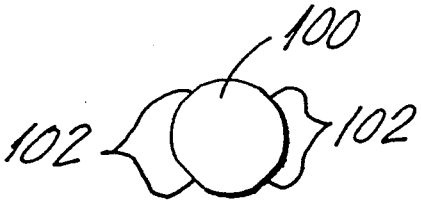
FIGS. 9A and 9B are schematic end views of jewelry chains after having been diamond cut in accordance with the methods of FIGS. 8A and 8B respectively.

In FIG. 8A, there is illustrated a pair of grinding wheels 50*a* and 50*b*, adapted for rotation about respective axes 52*a* and 52*b*. As seen in the drawings, the wheels 50*a* and 50*b* may be spaced slightly apart to as to take up an uncut chain 100 fed therebetween and so as to impart thereto a plurality of high luster surfaces 36 (FIGS. 4, 5 and 6) on a predetermined number of chain facets 102. In the illustrated embodiment, each grinding wheel has a pair of grinding surfaces 54 and 56 arranged in a V configuration. Accordingly, as seen schematically in FIG. 9A, the configuration of the chain 100 as viewed from the end may be circular, but with four chain facets 102.

Figure 9B:
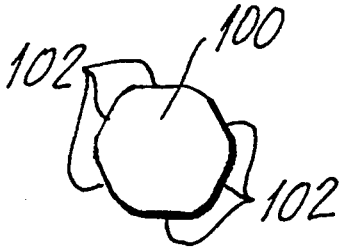

The apparatus illustrated in FIG. 8B is similar to that of FIG. 8A and is thus not described in detail herein, except for its differences. As seen, each grinding wheel 60*a* and 60*b* has three grinding surfaces 62, 64 and 66, thereby to impart a quasi-hexagonal configuration to chain 100 when viewed from the end. This is illustrated in FIG. 9B.

It will be appreciated by persons skilled in the art that the scope of the present invention is not limited by what has been shown and described above, merely by way of example. The scope of the present invention is limited, rather, solely by the claims which follow.

I claim:

1. A link for a fine jewelry chain, comprising:

a tubular member having a generally uniform wall thickness in cross section and having a peripheral outer wall surface;

said link being shaped into a link configuration and having an outwardly facing link perimeter;

a raised wall section formed integrally with and protruding outwardly from a portion of said peripheral outer wall surface to define at said portion a wall section of greater thickness than said uniform wall thickness, said raised wall section extending longitudinally along said link at said outwardly facing link perimeter, and at least one diamond cut high luster surface formed along said raised wall section.

2. A link according to claim 1, and wherein said peripheral outer wall surface is curved and said at least one diamond-cut high luster surface is parallel to a tangent to said peripheral outer wall surface.

3. A link according to claim 1, and wherein said peripheral outer wall surface is curved and said at least one diamond-cut high luster surface is tangential to said peripheral outer wall surface.

4. A link according to claim 1, and wherein said link is a hollow link.

5. A link according to claim 1, and wherein the thickness of said raised wall section varies between:

a. a thickness that does not differ substantially from the uniform wall thickness at a central portion of said high-luster surface, and b. a thickness equal to the uniform wall thickness with the thickness of the raised wall section at a location whereat said high luster surface is not provided.

6. A link according to claim 5, and wherein the thickness of said link is not substantially less than the uniform wall thickness at a central portion of said high-luster surface.

7. A link according to claim 1, and wherein said tubular member has a generally rounded cross-section.

8. A link according to claim 1, and comprising a rope chain link.

9. A fine jewelry chain having an assembly of links, such links of which comprises:

a tubular member having a generally uniform wall thickness in cross section and having a peripheral outer wall surface;

said link being shaped into a link configuration and having an outwardly facing link perimeter;

a raised wall section formed integrally with and protruding outwardly from a portion of said peripheral outer wall surface to define at said portion a wall section of greater thickness than said uniform wall thickness, said raised wall section extending longitudinally along said link at said outwardly facing link perimeter, and at least one diamond cut high luster surface formed along said raised wall section.

10. A chain according to claim 9, and wherein said peripheral outer wall surface is curved and said at least one diamond-cut high luster surface is parallel to a tangent to said peripheral outer wall surface.

11. A chain according to claim 9, and wherein said peripheral outer wall surface is curved and said at least one diamond-cut high luster surface is tangential to said peripheral outer wall surface.

12. A chain according to claim 9, and wherein said assembly of links is an assembly of hollow links.

13. A chain according to claim 9, and wherein the thickness of said raised wall section varies between:

a. a thickness that does not differ substantially from the uniform wall thickness at a central portion of said high-luster surface, and b. a thickness equal to the uniform wall thickness with the thickness of the raised wall section at a location whereat said high luster surface is not provided.

14. A chain according to claim 13, and wherein the thickness of said link is not substantially less than the uniform wall thickness at a central portion of said high-luster surface.

15. A chain according to claim 9, and wherein said tubular member has a generally rounded cross-section.

16. A chain according to claim 9, and comprising a rope chain.

17. A method of manufacturing a diamond cut high luster fine jewelry chain comprising the steps of:

milling an elongate portion of a precious metal so as to provide a plurality of portions of metal link wire each along said wall and having an elongate wall of uniform thickness and a longitudinally oriented raised section having a greater wall thickness formed therealong; and forming each portion of link wire into the shape of a link; and diamond cutting selected parts of the raised sections so as to form at least one high luster surface thereon without substantially cutting into the uniform thickness of the wall.

18. A method according to claim 17, and wherein said step of forming comprises the step of passing the link wire through a die so as to impart to the wall and to an outward-facing surface thereof a generally curved cross-section, and said step of diamond cutting comprises the step of cutting at least one high luster surface in a direction tangential to the outward-facing surface.

19. A method according to claim 17, and wherein said step of forming comprises the step of passing the link wire through a die so as to impart to the wall and to an outward-facing surface thereof a generally curved cross-section, and said step of diamond cutting comprises the step of cutting at least one high luster surface in a direction parallel to a tangent to the outward-facing surface.

20. A method according to claim 17, and also including the step of assembling said plurality of chain links into a chain prior to said step of diamond cutting.

21. A method according to claim 20, and wherein said step of diamond cutting comprises the step of forming plural high luster surfaces about the periphery of the assembled chain simultaneously.

22. A method according to claim 17, and wherein said step of forming comprises the step of forming each portion of link wire into a hollow link.

23. A method according to claim 17, and comprising a method of manufacturing a rope chain.

24. A hollow link for a fine jewelry chain wherein said link has a cross-section defining a tubular base portion of generally uniform wall thickness, and a raised portion formed integrally with and protruding outwardly from said base portion, said raised portion extending longitudinally along an outward-facing perimeter surface of said link, wherein said raised portion has at least one diamond cut high luster surface formed thereon without deforming the link cross-section.

25. A fine jewelry chain having an assembly of links, each of which comprises:

a cross-section defining a tubular base portion of generally uniform wall thickness, and a raised portion formed integrally with and protruding outwardly from said base portion, said raised portion extending longitudinally along an outward-facing perimeter surface of said link, wherein said raised portion has at least one diamond cut high luster surface formed thereon without deformation of the link cross-section.

26. A method of manufacturing a diamond cut high luster fine jewelry chain comprising:

providing a plurality of chain links each having a cross-section defining a tubular base portion of generally uniform wall thickness and a raised portion formed integrally with and protruding outwardly from said base portion, said raised portion extending longitudinally along an outward-facing perimeter surface of said link, wherein said raised portion has at least one diamond cut high-luster surface formed thereon without deforming the link cross-section, and assembling the plurality of chain links into a chain.

* * * * *